US011375759B2

(12) United States Patent
Wallace et al.

(10) Patent No.: US 11,375,759 B2
(45) Date of Patent: Jul. 5, 2022

(54) MASSAGING GARMENT ASSEMBLY

(71) Applicants: Roberto Wallace, Staten Island, NY (US); Alyissa Yoland Wallace, Staten Island, NY (US)

(72) Inventors: Roberto Wallace, Staten Island, NY (US); Alyissa Yoland Wallace, Staten Island, NY (US)

( * ) Notice: Subject to any disclaimer, the term of this patent is extended or adjusted under 35 U.S.C. 154(b) by 636 days.

(21) Appl. No.: 16/385,120

(22) Filed: Apr. 16, 2019

(65) Prior Publication Data

US 2020/0329784 A1 Oct. 22, 2020

(51) Int. Cl.
*A41D 1/00* (2018.01)
*A61H 15/00* (2006.01)

(52) U.S. Cl.
CPC ..... *A41D 1/005* (2013.01); *A61H 15/0078* (2013.01); *A41D 2400/322* (2013.01); *A61H 2015/005* (2013.01); *A61H 2015/0014* (2013.01); *A61H 2201/165* (2013.01)

(58) Field of Classification Search
CPC ..... A41D 1/005; A41D 2400/322; A61H 2201/165; A61H 15/0078; A61H 2015/0021; A61H 2015/0042
See application file for complete search history.

(56) References Cited

U.S. PATENT DOCUMENTS 3,310,050 A 3/1967 Goldfarb
5,535,453 A 7/1996 Howard
7,207,953 B1 * 4/2007 Goicaj ..... A61H 23/02 601/134
7,653,948 B2 2/2010 Schwenner
D801,007 S 10/2017 Pezzimenti
2004/0133133 A1 * 7/2004 Dreimann ..... A61H 23/0263 601/15
2008/0243041 A1 10/2008 Brenner
2009/0234261 A1 * 9/2009 Singh ..... A61B 17/1325 601/152
2012/0117702 A1 * 5/2012 King ..... A41B 17/005 2/2.16
2015/0223526 A1 8/2015 Nolan
2015/0359701 A1 * 12/2015 Moyer ..... A61H 15/0092 601/131
2017/0157431 A1 * 6/2017 Cheatham, III ..... A61N 2/002
2018/0042810 A1 * 2/2018 Nguyen ..... A61H 23/02
2020/0078260 A1 * 3/2020 Choudhury ..... A41D 1/002

* cited by examiner

*Primary Examiner* — Margaret M Luarca
*Assistant Examiner* — Cana A Gallegos

(57) ABSTRACT

A massaging garment assembly includes a body suit that is wearable on a user's body to cover areas of the user's body generally associated with massage therapy. A plurality of first massage balls is each of movably embedded into the body suit to massage the user's body at common massage point. A plurality of sets of second massage balls is each movably embedded into the body suit to massage the user's body at the common massage points. A plurality of first massage rollers is each of the first massage rollers is movably embedded into the body suit to massage the user's body at the common massage points. A plurality of sets of second massage rollers is each movably embedded into the body suit to massage the user's body at the common massage points.

9 Claims, 6 Drawing Sheets

MASSAGING GARMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to massage devices and more particularly pertains to a new massage device for massaging a user at common massage points on the user's body.

BRIEF SUMMARY OF THE INVENTION

An embodiment of the disclosure meets the needs presented above by generally comprising a body suit that is wearable on a user's body to cover areas of the user's body generally associated with massage therapy. A plurality of first massage balls is each of movably embedded into the body suit to massage the user's body at common massage point. A plurality of sets of second massage balls is each movably embedded into the body suit to massage the user's body at the common massage points. A plurality of first massage rollers is each of the first massage rollers is movably embedded into the body suit to massage the user's body at the common massage points. A plurality of sets of second massage rollers is each movably embedded into the body suit to massage the user's body at the common massage points.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
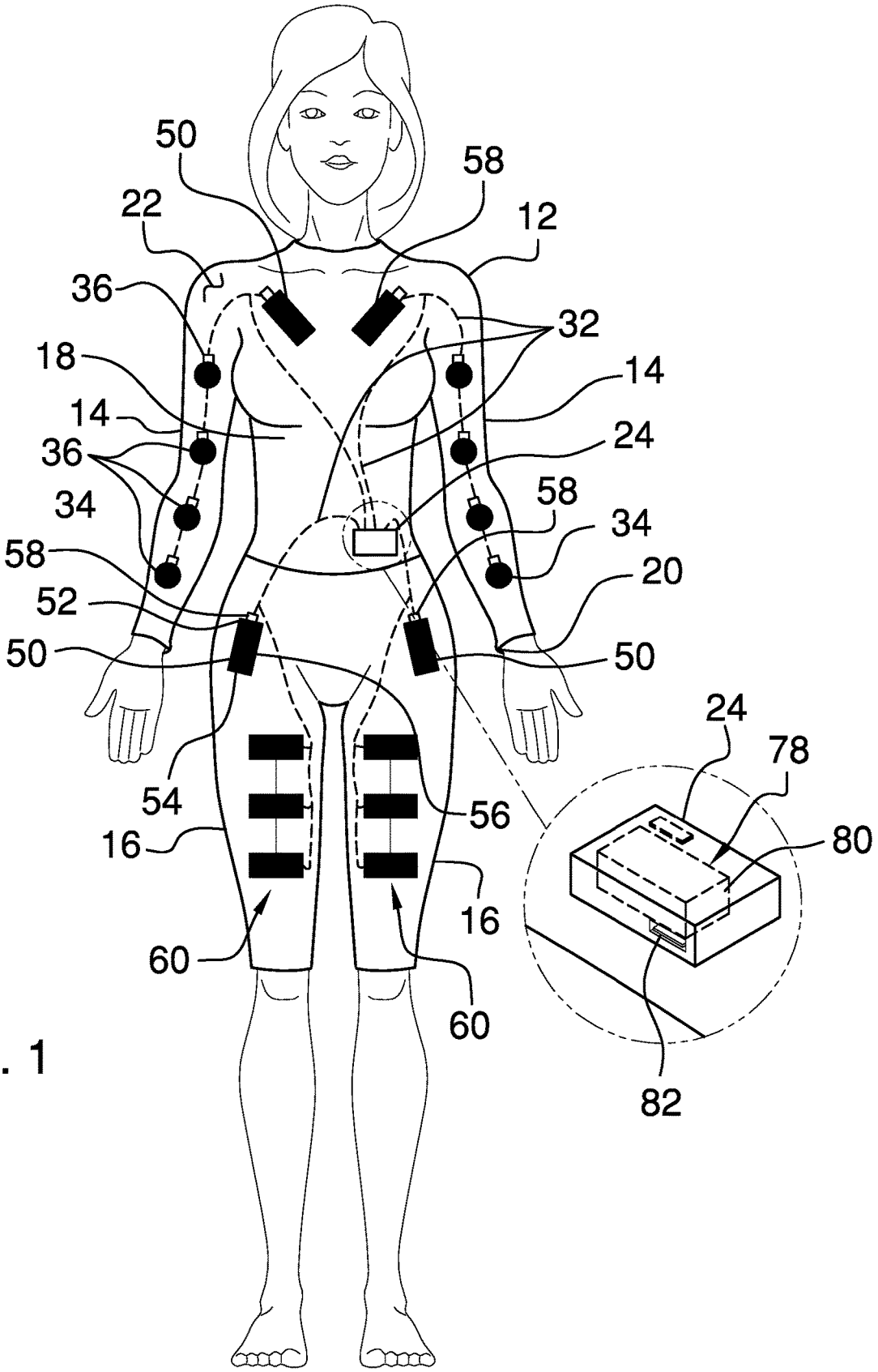
FIG. 1 is a front phantom view of a massaging garment assembly according to an embodiment of the disclosure.
Figure 2:
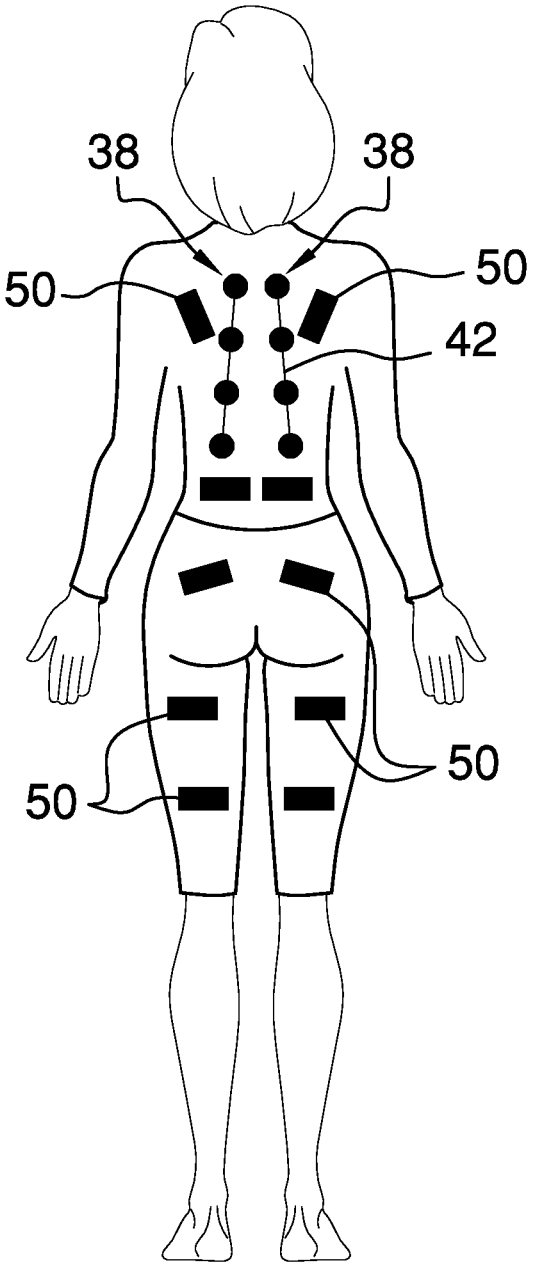
FIG. 2 is a back view of an embodiment of the disclosure.
Figure 3:
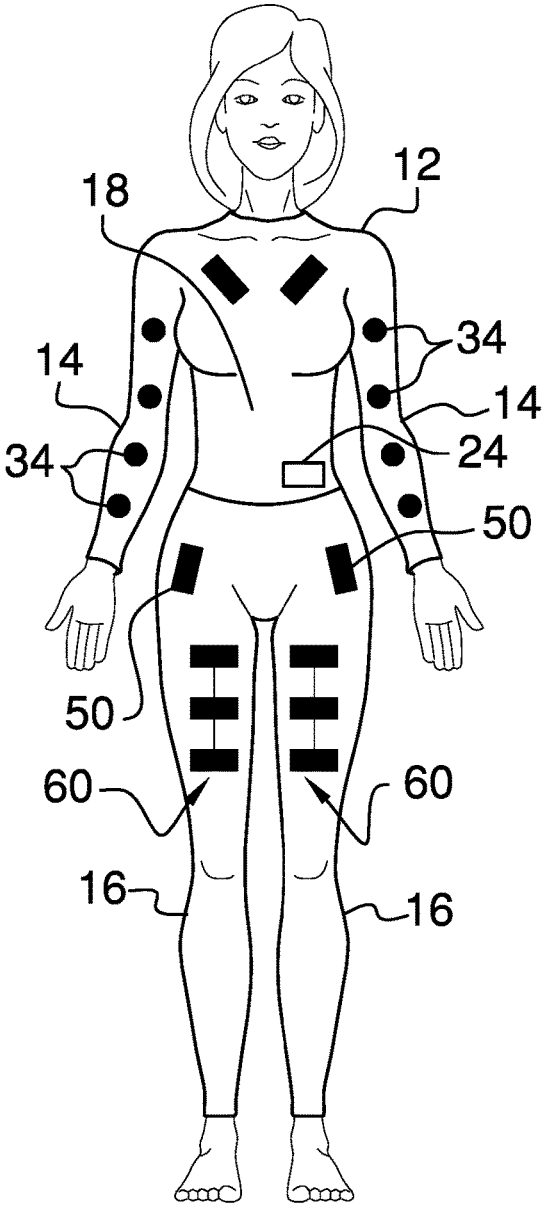
FIG. 3 is a front view of an embodiment of the disclosure.
Figure 4:
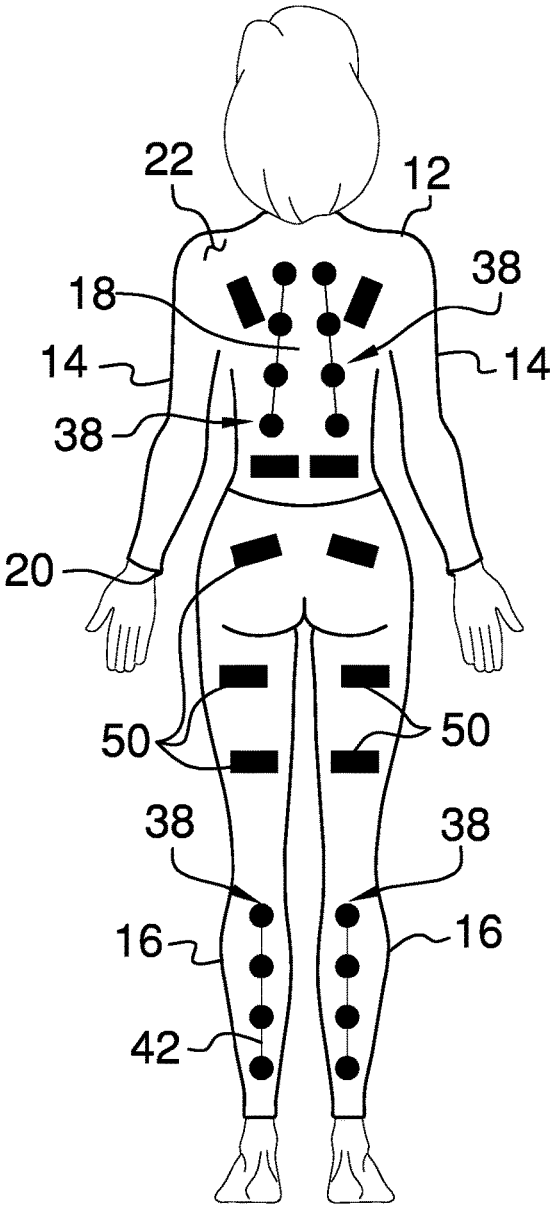
FIG. 4 is a rear view of an embodiment of the disclosure.
Figure 5:
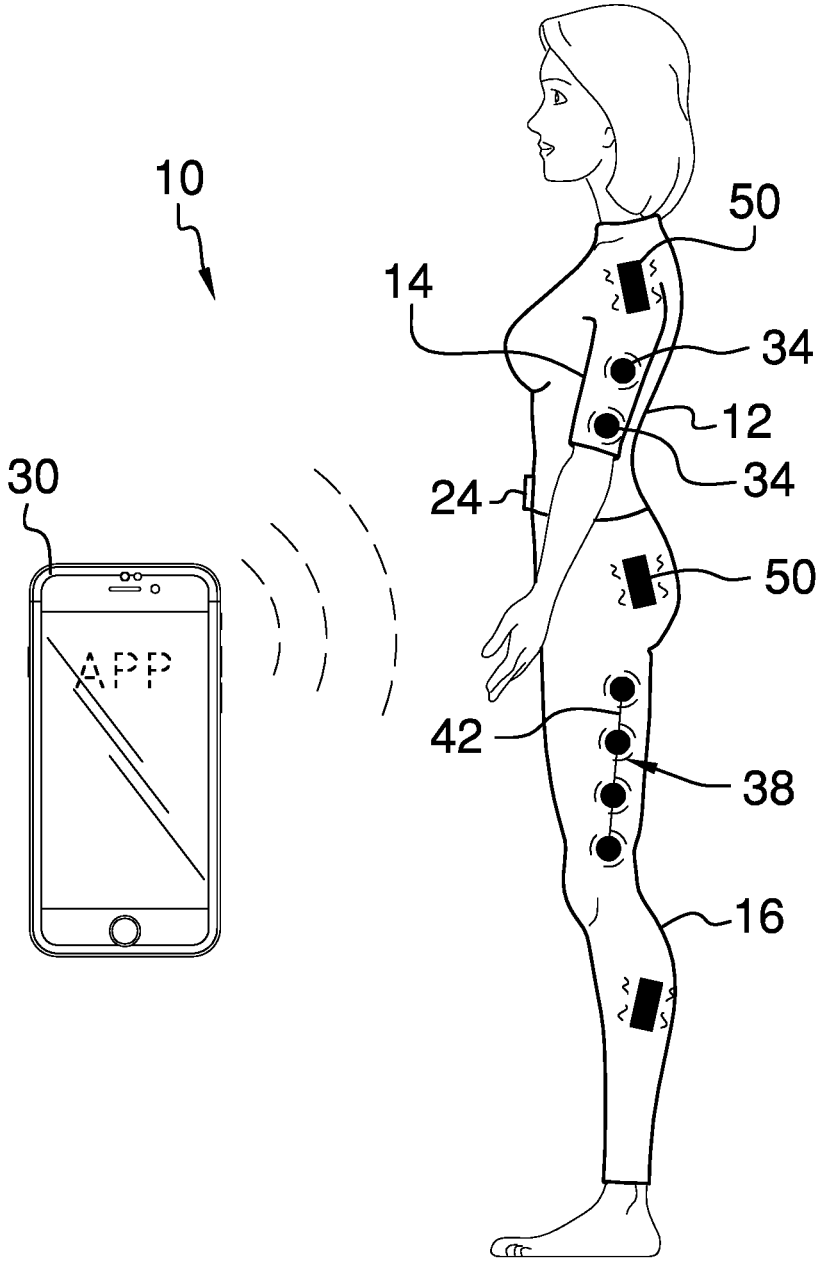
FIG. 5 is a left side view of an embodiment of the disclosure.
Figure 6:
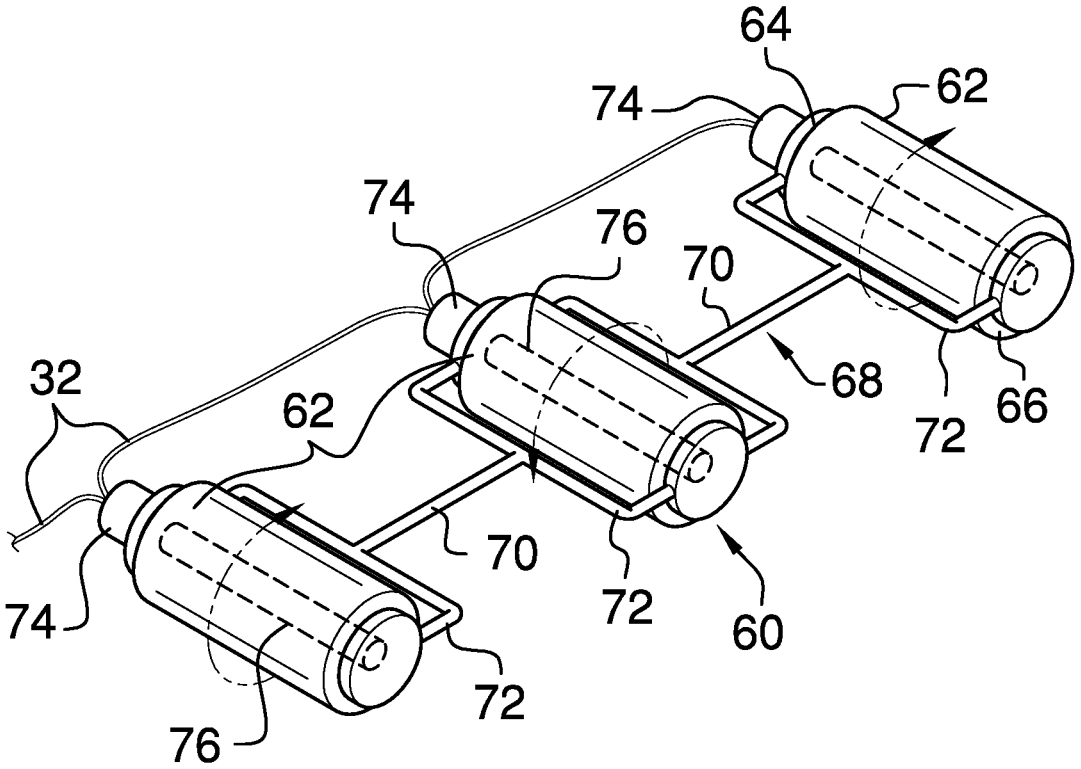
FIG. 6 is a perspective phantom view of a set of second massage rollers of an embodiment of the disclosure.
Figure 7:
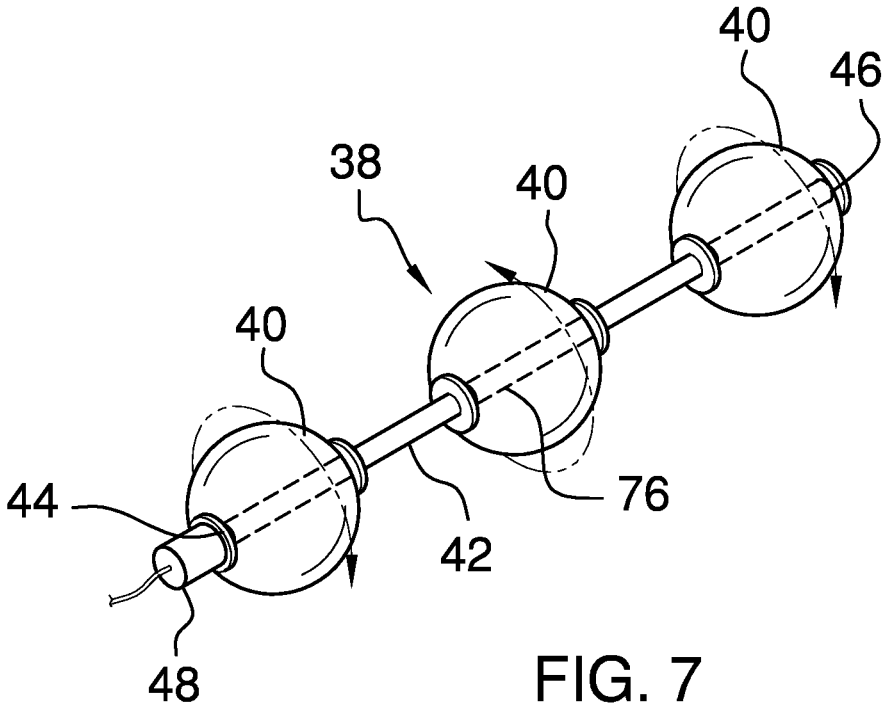
FIG. 7 is a perspective phantom view of a set of second massage balls of an embodiment of the disclosure.
Figure 8:
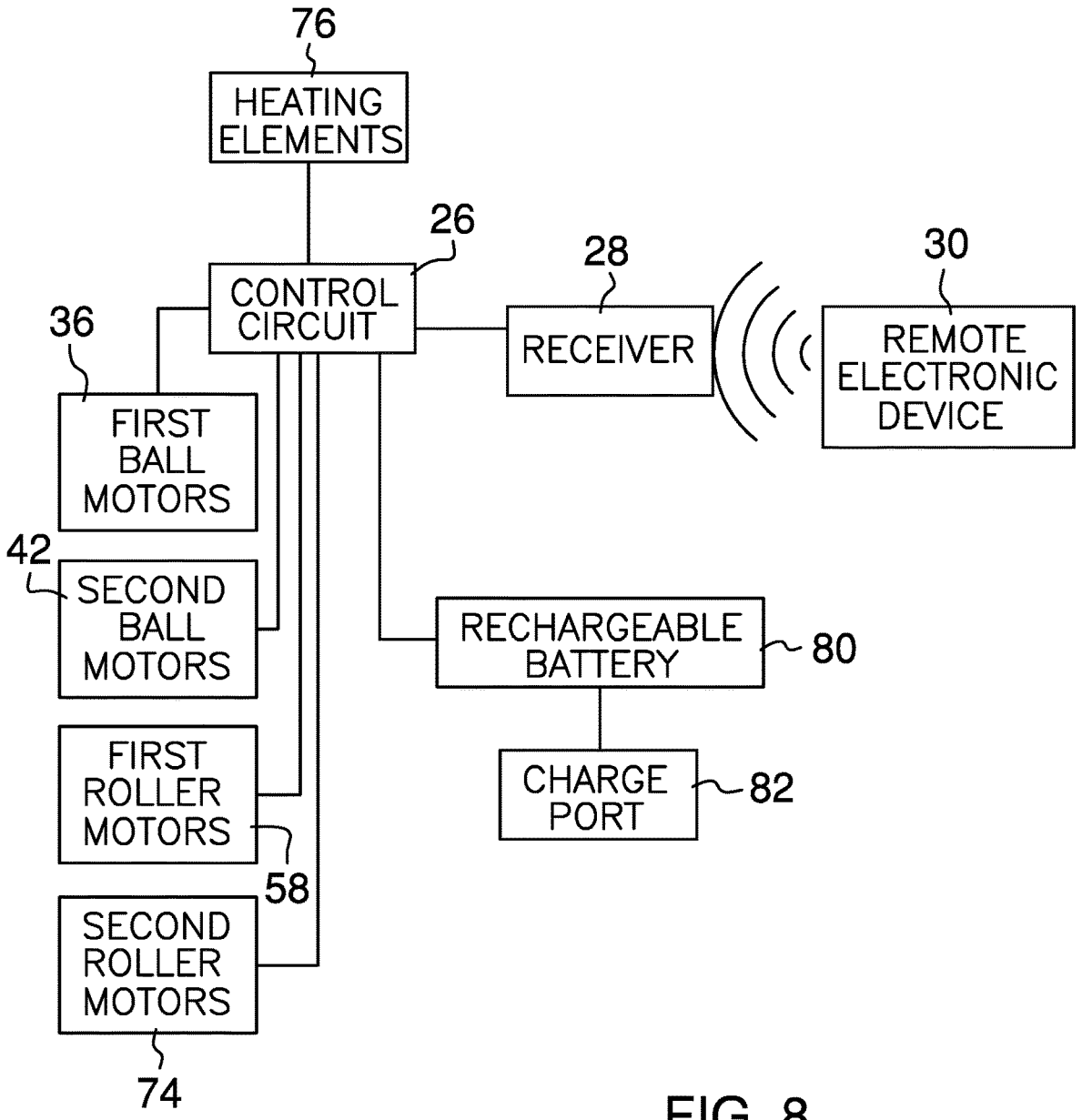
FIG. 8 is a schematic view of an embodiment of the disclosure.

With reference now to the drawings, and in particular to FIGS. 1 through 8 thereof, a new massage device embodying the principles and concepts of an embodiment of the disclosure and generally designated by the reference numeral 10 will be described.

As best illustrated in FIGS. 1 through 8, the massaging garment assembly 10 generally comprises a body suit 12 that is wearable on a user's body such that said body suit 12 covers areas of the user's body generally associated with massage therapy. The body suit 12 has a pair of sleeves 14, a pair of legs 16 and a torso portion 18. Each of the sleeves 14 insertably receives a respective one of the user's arms, each of said legs 16 insertably receives a respective one of the user's legs and said torso portion 18 covers the user's torso. The body suit 12 has an inside surface 20 and an outside surface 22, and the body suit 12 is comprised of a resiliently stretchable material. In this way the body suit 12 can conform to contours of the user's body when the body suit 12 is worn. As is most clearly shown in FIGS. 1 and 2, the body suit 12 may be produced with short legs 16 with terminate near the user's knees. As is most clearly shown in FIGS. 3 and 4, the body suit 12 may be produced with long legs 16 that terminate near the user's ankles. As is most clearly shown in FIGS. 1 through 4, the body suit 12 may be produced with long sleeves 14. As is most clearly shown in FIG. 5, the body suit 12 may be produced with short sleeves 14.

A control housing 24 is coupled to the body suit 12 and the control housing 24 is positioned on the outside surface 22 of the body suit 12 thereby facilitating the control housing 24 to be accessible to the user. A control circuit 26 is positioned within the control housing 24 and the control circuit 26 receives an on input and an off input. A receiver 28 is positioned within the control housing 24 and the receiver 28 is electrically coupled to the control circuit 26.

Moreover, the receiver 28 is in wireless electrical communication with a remote electronic device 30, such as a smart phone or the like.

The control circuit 26 receives the on input when the receiver 28 receives an on command from the remote electronic device 30. Additionally, the control circuit 26 receives the off input when the receiver 28 receives an off command from the remote electronic device 30. The remote electronic device 30 may store an app, or other similar type of control software, for producing the on and off commands. The receiver 28 may be a radio frequency receiver 28 or the like and the receiver 28 may employ Bluetooth communication protocols.

As is most clearly shown in FIG. 1, an array of conductors 32 is positioned between the inside surface 20 and the outside surface 22 of the body suit 12 and each of the array of conductors 32 is electrically coupled to the control circuit 26. Additionally, each of the array of conductors 32 extends from the control housing 24 through respective ones of the sleeves 14, the legs 16 and the torso portion 18 of the body suit 12. The array of conductors 32 may comprise wires or other flexible type of electrical conductor.

A plurality of first massage balls 34 is each movably embedded into the body suit 12. Each of the first massage balls 34 is positioned at strategic locations on the body suit 12 that correspond to common massage points on the user's body. In this way each of the first massage balls 34 can massage the user's body at the common massage points when each of the first massage balls 34 is turned on. Each of the first massage balls 34 is in communication with the control circuit 26 and each of the first massage balls 34 is comprised of a resiliently compressible material for enhancing comfort for the user. The plurality of first massage balls 34 may be distributed on a respective one of said sleeves 14 of said body suit 12.

A plurality of first ball motors 36 is each positioned between the inside 20 and outside 22 surfaces of the body suit 12. Additionally, each of the first ball motors 36 is bonded to the body suit 12 to inhibit each of the first ball motors 36 from moving. Each of the first ball motors 36 is electrically coupled to a respective one of the array of conductors 32 such that each of the first ball motors 36 is in electrical communication with the control circuit 26. Additionally, each of the first ball motors 36 is turned on when the control circuit 26 receives the on input. Each of the first ball motors 36 has a respective one of the first massage balls 34 being rotatably coupled thereto. In this way each of the first massage balls 34 can massage the user's body when the control circuit 26 receives the on input. Each of the first ball motors 36 may be an electrical motor or the like.

A plurality of sets of second massage balls 38 is each movably embedded into the body suit 12. Each of the sets of second massage balls 38 is positioned at strategic locations on the body suit 12 that correspond to common massage points on the user's body. In this way each of the sets of second massage balls 38 can massage the user's body at the common massage points when each of the sets of second massage balls 38 is turned on. Each of the sets of second massage balls 38 is in electrical communication with the control circuit 26. As is most clearly shown in FIGS. 2, 4 and 5, respective ones of the sets of second massage balls 38 may be aligned on each side of the user's spine, the user's calves and the outside of the user's thighs when the body suit 12 is worn.

Each of the sets of second of massage balls 38 includes a plurality of balls 40 that is each comprised of a resiliently compressible material for enhancing comfort for the user. Each of the balls 40 is positioned between the inside surface 20 and the outside surface 22 of the body suit 12. Each of the sets of second massage balls 38 further includes a shaft 42 that has a first end 44 and a second end 46. The shaft 42 extends through each of the balls 40 and the balls 40 are spaced apart from each other and are distributed between the first 44 and second 46 ends. The shaft 42 is comprised of a pliable material to facilitate the shaft 42 to conform to contours of the user's body when the body suit 12 is worn.

Each of the sets of second massage balls 38 includes a second ball motor 48 that is positioned between the inside surface 20 and the outside surface 22 of the body suit 12. The second ball motor 48 is bonded to the body suit 12 to inhibit the second ball motor 48 from moving. The second ball motor 48 has the first end 44 of the shaft 42 being rotatably coupled thereto such that the second ball motor 48 rotates each of the balls 40 when the second ball motor 48 is turned on. The second ball motor 48 is electrically coupled to a respective one of the array of conductors 32 such that the second ball motor 48 is in electrical communication with the control circuit 26. Additionally, the second ball motor 48 may be an electric motor or the like.

A plurality of first massage rollers 50 is each movably embedded into the body suit 12. Each of the first massage rollers 50 is positioned at strategic locations on the body suit 12 that correspond to common massage points on the user's body. In this way each of the first massage rollers 50 can massage the user's body at the common massage points when each of the first massage rollers 50 is turned on. Each of the first massage rollers 50 is in electrical communication with the control circuit 26. Additionally, each of the first massage rollers 50 is comprised of a resiliently compressible material for enhancing comfort for the user. Each of the first massage rollers 50 has a primary end 52, a secondary end 54 and an outer surface 56, and each of the first massage rollers 50 is elongated between the primary 52 and secondary ends 54. As is most clearly shown in FIGS. 1, 2 and 4, respective ones of the first massage rollers 50 may be aligned with the user's chest, hips, shoulder blades, rear thighs, buttocks and hips when the body suit 12 is worn.

A plurality of first roller motors 58 is each positioned between the inside 20 and outside 22 surfaces of the body suit 12. Each of the first roller motors 58 is bonded to the body suit 12 to inhibit each of the first roller motors 58 from moving. Additionally, each of the first roller motors 58 is electrically coupled to a respective one of the array of conductors 32 such that each of the first roller motors 58 is in electrical communication with the control circuit 26. Each of the first roller motors 58 is turned on when the control circuit 26 receives the on input. Each of the first roller motors 58 has the primary end 52 of a respective one of the first massage rollers 50 being rotatably coupled thereto. Thus, the outer surface 54 of each of the first massage rollers 50 can massage the user's body when the control circuit 26 receives the on input. Moreover, each of the first massage rollers 50 rotates about an axis extending through the primary 52 and secondary 54 ends of the first massage rollers 50.

A plurality of sets of second massage rollers 60 is each movably embedded into the body suit 12. Each of the sets of second massage rollers 60 is positioned at strategic locations on the body suit 12 that correspond to common massage points on the user's body. Thus, each of the sets of second massage rollers 60 can massage the user's body at the common massage points when each of the sets of second massage rollers 60 is turned on. Each of the sets of second massage rollers 60 is in electrical communication with the control circuit 26. As is most clearly shown in FIGS. 1 and 3, respective ones of the sets of second massage rollers 60 may be aligned with the front of the user's thighs when the body suit 12 is worn.

Each of the sets of second massage rollers 60 comprises a plurality of rollers 62, and each of the rollers 62 is comprised of a resiliently compressible material for enhancing comfort for the user. Each of the rollers 62 is positioned between the inside surface 20 and the outside surface 22 of the body suit 12. Additionally, each of the rollers 62 has a first end 64 and a second end 66. Each of the sets of second massage rollers 60 includes a track 68, and the track 68 includes a plurality of rail sections 70 each extending between a plurality of bracket sections 72. The bracket sections 72 are spaced apart from each on the track 68 and each of the rollers 62 is positioned within a respective one of the bracket sections 72. Each of the first 64 and second 66 ends of each of the rollers 62 is rotatably coupled to the respective bracket sections 72. Moreover, the track 68 is comprised of a pliable material such that the track 68 conforms to contours of the user's body when the body suit 12 is worn.

A plurality of second roller motors 74 is each positioned between the inside surface 20 and the outside surface 22 of the body suit 12. Each of the second roller motors 74 is bonded to the body suit 12 to inhibit each of the second roller motors 74 from moving. Additionally, each of the second roller motors 74 is positioned on a respective one of the bracket portions of the track 68. Additionally, each of the second roller motors 74 has the first end 64 of a respective one of the rollers 62 being rotatably coupled thereto.

Each of the second roller motors 74 rotates the respective roller 62 when the second roller motors 74 are turned on. Additionally, the each of the rollers 62 may be rotated in opposite direction from each other along the length of the track 68. Each of the second roller motors 74 is electrically coupled to a respective one of the array of conductors 32 such that each of second roller motors 74 is in electrical communication with the control circuit 26. Additionally, each of the second roller motors 74 may comprise an electric motor or the like.

A plurality of heating elements 76 is provided, and each of the heating elements 76 is positioned within a respective one of the first massage balls 34, the sets of second massage balls 38, the first massage rollers 50 and the sets of second massage rollers 60. Each of the heating elements 76 is electrically coupled to a respective one of the array of conductors 32. Thus, each of the heating elements 76 is in electrical communication with the control circuit 26. Each of the heating elements 76 may comprise an electrical heating element or the like. Moreover, each of the heating elements 76 may have an operational temperature commonly associated with heat therapy for muscles.

A power supply 78 is coupled to the control housing 24 and the power supply 78 is electrically coupled to the control circuit 26. The power supply 78 comprises at least one rechargeable battery 80 that is positioned within the control housing 24. The at least one rechargeable battery 80 is electrically coupled to the control circuit 26. A charge port 82 is recessed into the control housing 24 for insertably receiving a plug on a battery charger. The charge port 82 is electrically coupled to the at least one rechargeable battery 80 for charging the at least one rechargeable battery 80. The charge port 82 may be a usb port or any other type of electrical port that corresponds to the plug on the battery charger.

In use, the body suit 12 is worn when the user needs therapeutic massage on various locations on their body. Thus, each of the first massage balls 34, the sets of second massage balls 38, the first massage rollers 50 and the sets of second massage rollers 60 is aligned with respective massage points on the user's body. In this way the user can enjoy a full body massage while the body suit 12 is being worn. The remote electronic device 30 is manipulated to communicate the on command or the off command to the receiver 28. In this way each of the first massage balls 34, the sets of second massage balls 38, the first massage roller and the sets of second massage rollers 60 can be turned on and off.

Each of the first massage balls 34, the sets of second massage balls 38, the first massage rollers 50 and the sets of second massage rollers 60 can be individually turned on and off with respect to each other. In this way the user can experience massage therapy only on specified areas of the body rather than a full body massage. Additionally, the heating element 76 in each of the first massage balls 34, the sets of second massage balls 38, the first massage rollers 50 and the sets of second massage rollers 60 can be selectively turned on and off for combining heat therapy with the massage therapy.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A massaging garment assembly being configured to be worn on a user's body for massaging pre-selected points on the user's body, said assembly comprising:

a body suit being wearable on a user's body wherein said body suit is configured to cover areas of the user's body generally associated with massage therapy;

a control circuit being positioned within a control housing;

a plurality of first massage balls, each of said first massage balls being movably embedded into said body suit, each of said first massage balls being positioned at strategic locations on said body suit that correspond to common massage points on the user's body wherein each of said first massage balls is configured to massage the user's body at the common massage points when each of said first massage balls is turned on, each of said first massage balls being in communication with said control circuit, each of said first massage balls being comprised of a resiliently compressible material for enhancing comfort for the user;

a plurality of sets of second massage balls, each of said sets of second massage balls being movably embedded into said body suit, each of said sets of second massage balls being positioned at strategic locations on said body suit that correspond to common massage points on the user's body wherein each of said sets of second massage balls is configured to massage the user's body at the common massage points when each of said sets of second massage balls is turned on, each of said sets of second massage balls being in communication with said control circuit;

a plurality of first massage rollers, each of said first massage rollers being movably embedded into said body suit, each of said first massage rollers being positioned at strategic locations on said body suit that correspond to common massage points on the user's body wherein each of said first massage rollers is configured to massage the user's body at the common massage points when each of said first massage rollers is turned on, each of said first massage rollers being in communication with said control circuit, each of said first massage rollers being comprised of a resiliently compressible material for enhancing comfort for the user;

a plurality of sets of second massage rollers, each of said sets of second massage rollers being movably embedded into said body suit, each of said sets of second massage rollers being positioned at strategic locations on said body suit that correspond to common massage points on the user's body wherein each of said sets of second massage rollers is configured to massage the user's body at the common massage points when each of said sets of second massage rollers is turned on, each of said sets of second massage rollers being in communication with said control circuit;

the body suit having a pair of sleeves each configured to insertably receive a respective one of the user's arms, said body suit has a pair of lees each configured to insertably receive a respective one of the user's legs, said body suit having a torso portion configured to cover the user's torso, said body suit having an inside surface and an outside surface, said body suit being comprised of a resiliently stretchable material wherein said body suit is configured to conform to contours of the user's body when said body suit is worn;

said control housing being coupled to said body suit, said control housing being positioned on said outside surface of said body suit thereby facilitating said control housing to be accessible to the user;

said assembly includes a receiver being positioned within said control housing, said receiver being electrically coupled to said control circuit, said receiver being in wireless electrical communication with a remote electronic device, said control circuit receiving an on input when said receiver receives an on command from the remote electronic device, said control circuit receiving an off input when said receiver receives an off command from the remote electronic device;

an array of conductors, said array of conductors being positioned between said inside surface and said outside surface of said body suit, each of said array of conductors being electrically coupled to said control circuit, each of said array of conductors extending from said control housing through respective ones of said sleeves, said lees and said torso portion; and wherein each of said sets of second massage balls comprises a plurality of balls, each of said balls being comprised of a resiliently compressible material for enhancing comfort for the user, each of said balls being positioned between said inside surface and said outside surface of said body suit, and a shaft having a first end and a second end, said shaft extending through each of said balls having said balls being spaced apart from each other and being distributed between said first and second ends, said shaft being comprised of a pliable material wherein said shaft is configured to conform to contours of the user's body when said body suit is worn.

2. The assembly according to claim 1, further comprising a plurality of first ball motors, each of said first ball motors being positioned between said inner and outer surfaces of said body suit, each of said first ball motors being bonded to said body suit to inhibit each of said first ball motors from moving, each of said first ball motors being electrically coupled to a respective one of said array of conductors such that each of said first ball motors is in electrical communication with said control circuit, each of said first ball motors being turned on when said control circuit receives said on input, each of said first ball motors having a respective one of said first massage balls being rotatably coupled thereto wherein each of said first massage balls is configured to massage the user's body when said control circuit receives said on input.

3. The assembly according to claim 2, further comprising a second ball motor being positioned between said inside surface and said outside surface of said body suit, said second ball motor being bonded to said body suit to inhibit said second ball motor from moving, said second ball motor having said first end of said shaft being rotatably coupled thereto such that said second ball motor rotates each of said balls when said second ball motor is turned on, said second ball motor being electrically coupled to a respective one of said array of conductors such that said second ball motor is in electrical communication with said control circuit.

4. The assembly according to claim 1, wherein:

each of said first massage rollers has a primary end and a secondary end, each of said first massage rollers being elongated between said primary and secondary ends;

said assembly includes a plurality of first roller motors, each of said first roller motors being positioned between said inner and outer surfaces of said body suit, each of said first roller motors being bonded to said body suit to inhibit each of said first roller motors from moving; and each of said first roller motors has said primary end of a respective one of said first massage rollers being rotatably coupled thereto wherein said outer surface of each of said first massage rollers is configured to massage the user's body when said control circuit receives said on input, each of said first roller motors being electrically coupled to a respective one of said array of conductors such that each of said first roller motors is in electrical communication with said control circuit, each of said first roller motors being turned on when said control circuit receives said on input.

5. The assembly according to claim 1, wherein each of said second sets of massage rollers comprises a plurality of rollers, each of said rollers being comprised of a resiliently compressible material for enhancing comfort for the user, each of said rollers being positioned between said inside surface and said outside surface of said body suit, each of said rollers having a first end and a second end.

6. A massaging garment assembly being configured to be worn on a user's body for massaging pre-selected points on the user's body, said assembly comprising:

a body suit being wearable on a user's body wherein said body suit is configured to cover areas of the user's body generally associated with massage therapy;

a control circuit being positioned within a control housing;

a plurality of first massage balls, each of said first massage balls being movably embedded into said body suit, each of said first massage balls being positioned at strategic locations on said body suit that correspond to common massage points on the user's body wherein each of said first massage balls is configured to massage the user's body at the common massage points when each of said first massage balls is turned on, each of said first massage balls being in communication with said control circuit, each of said first massage balls being comprised of a resiliently compressible material for enhancing comfort for the user;

a plurality of sets of second massage balls, each of said sets of second massage balls being movably embedded into said body suit, each of said sets of second massage balls being positioned at strategic locations on said body suit that correspond to common massage points on the user's body wherein each of said sets of second massage balls is configured to massage the user's body at the common massage points when each of said sets of second massage balls is turned on, each of said sets of second massage balls being in communication with said control circuit;

a plurality of first massage rollers, each of said first massage rollers being movably embedded into said body suit, each of said first massage rollers being positioned at strategic locations on said body suit that correspond to common massage points on the user's body wherein each of said first massage rollers is configured to massage the user's body at the common massage points when each of said first massage rollers is turned on, each of said first massage rollers being in communication with said control circuit, each of said first massage rollers being comprised of a resiliency compressible material for enhancing comfort for the user;

a plurality of sets of second massage rollers, each of said sets of second massage rollers being movably embedded into said body suit, each of said sets of second massage rollers being positioned at strategic locations on said body suit that correspond to common massage points on the user's body wherein each of said sets of second massage rollers is configured to massage the user's body at the common massage points when each of said sets of second massage rollers is turned on, each of said sets of second massage rollers being in communication with said control circuit;

the body suit having a pair of sleeves each configured to insertably receive a respective one of the user's arms, said body suit has a pair of legs each configured to insertably receive a respective one of the user's legs, said body suit having a torso portion configured to cover the user's torso, said body suit having an inside surface and an outside surface, said body suit being comprised of a resiliency stretchable material wherein said body suit is configured to conform to contours of the user's body when said body suit is worn;

said control housing being coupled to said body suit, said control housing being positioned on said outside surface of said body suit thereby facilitating said control housing to be accessible to the user;

said assembly includes a receiver being positioned within said control housing, said receiver being electrically coupled to said control circuit, said receiver being in wireless electrical communication with a remote electronic device, said control circuit receiving an on input when said receiver receives an on command from the remote electronic device, said control circuit receiving an off input when said receiver receives an off command from the remote electronic device;

an array of conductors, said array of conductors being positioned between said inside surface and said outside surface of said body suit, each of said array of conductors being electrically coupled to said control circuit, each of said array of conductors extending from said control housing through respective ones of said sleeves, said lees and said torso portion;

wherein each of said second sets of massage rollers comprises a plurality of rollers, each of said rollers being comprised of a resiliently compressible material for enhancing comfort for the user, each of said rollers being positioned between said inside surface and said outside surface of said body suit, each of said rollers having a first end and a second end; and wherein each of said second sets of massage rollers includes a track which includes a plurality of rail sections each extending between a plurality of bracket sections, said bracket sections being spaced apart from each other, each of said rollers being positioned within a respective one of said bracket sections, each of said first and second ends of each of said rollers being rotatably coupled to said respective bracket sections, said track being comprised of a pliable material wherein said track is configured to conform to contours of the user's body when said body suit is worn.

7. The assembly according to claim 6, wherein each of said second sets of massage rollers includes a plurality of second roller motors, each of said second roller motors being positioned between said inside surface and said outside surface of said body suit, each of said second roller motors being bonded to said body suit to inhibit each of said second roller motors from moving, each of said second roller motors being positioned on a respective one of said bracket portions of said track.

8. The assembly according to claim 7, wherein each of said second roller motors has said first end of a respective one of said rollers being rotatably coupled thereto such that each of said second roller motor rotates said respective roller when said second rollers motor are turned on, each of said second roller motors being electrically coupled to a respective one of said array of conductors such that said each of second roller motors is in electrical communication with said control circuit.

9. A massaging garment assembly being configured to be worn on a user's body for massaging pre-selected points on the user's body, said assembly comprising:

a body suit being wearable on a user's body wherein said body suit is configured to cover areas of the user's body generally associated with massage therapy, said body suit having a pair of sleeves each configured to insertably receive a respective one of the user's arms, said body suit having a pair of legs each configured to insertably receive a respective one of the user's legs, said body suit having a torso portion configured to cover the user's torso, said body suit having an inside surface and an outside surface, said body suit being comprised of a resiliently stretchable material wherein said body suit is configured to conform to contours of the user's body when said body suit is worn;

a control housing being coupled to said body suit, said control housing being positioned on said outside surface of said body suit thereby facilitating said control housing to be accessible to the user;

a control circuit being positioned within said control housing, said control circuit receiving an on input and an off input;

a receiver being positioned within said control housing, said receiver being electrically coupled to said control circuit, said receiver being in wireless electrical communication with a remote electronic device, said control circuit receiving said on input when said receiver receives an on command from the remote electronic device, said control circuit receiving said off input when said receiver receives an off command from the remote electronic device;

an array of conductors, said array of conductors being positioned between said inside surface and said outside surface of said body suit, each of said array of conductors being electrically coupled to said control circuit, each of said array of conductors extending from said control housing through respective ones of said sleeves, said legs and said torso portion;

a plurality of first massage balls, each of said first massage balls being movably embedded into said body suit, each of said first massage balls being positioned at strategic locations on said body suit that correspond to common massage points on the user's body wherein each of said first massage balls is configured to massage the user's body at the common massage points when each of said first massage balls is turned on, each of said first massage balls being in electrical communication with said control circuit, each of said first massage balls being comprised of a resiliently compressible material for enhancing comfort for the user;

a plurality of first ball motors, each of said first ball motors being positioned between said inner and outer surfaces of said body suit, each of said first ball motors being bonded to said body suit to inhibit each of said first ball motors from moving, each of said first ball motors being electrically coupled to a respective one of said array of conductors such that each of said first ball motors is in electrical communication with said control circuit, each of said first ball motors being turned on when said control circuit receives said on input, each of said first ball motors having a respective one of said first massage balls being rotatably coupled thereto wherein each of said first massage balls is configured to massage the user's body when said control circuit receives said on input;

a plurality of sets of second massage balls, each of said sets of second massage balls being movably embedded into said body suit, each of said sets of second massage balls being positioned at strategic locations on said body suit that correspond to common massage points on the user's body wherein each of said sets of second massage balls is configured to massage the user's body at the common massage points when each of said sets of second massage balls is turned on, each of said sets of second massage balls being in electrical communication with said control circuit, each of said sets of second massage balls comprising:

a plurality of balls, each of said balls being comprised of a resiliency compressible material for enhancing comfort for the user, each of said balls being positioned between said inside surface and said outside surface of said body suit;

a shaft having a first end and a second end, said shaft extending through each of said balls having said balls being spaced apart from each other and being distributed between said first and second ends, said shaft being comprised of a pliable material wherein said shaft is configured to conform to contours of the user's body when said body suit is worn; and a second ball motor being positioned between said inside surface and said outside surface of said body suit, said second ball motor being bonded to said body suit to inhibit said second ball motor from moving, said second ball motor having said first end of said shaft being rotatably coupled thereto such that said second ball motor rotates each of said balls when said second ball motor is turned on, said second ball motor being electrically coupled to a respective one of said array of conductors such that said second ball motor is in electrical communication with said control circuit;

a plurality of first massage rollers, each of said first massage rollers being movably embedded into said body suit, each of said first massage rollers being positioned at strategic locations on said body suit that correspond to common massage points on the user's body wherein each of said first massage rollers is configured to massage the user's body at the common massage points when each of said first massage rollers is turned on, each of said first massage rollers being in electrical communication with said control circuit, each of said first massage rollers being comprised of a resiliently compressible material for enhancing comfort for the user, each of said first massage rollers having a primary end and a secondary end, each of said first massage rollers being elongated between said primary and secondary ends, a plurality of first roller motors, each of said first roller motors being positioned between said inner and outer surfaces of said body suit, each of said first roller motors being bonded to said body suit to inhibit each of said first roller motors from moving, each of said first roller motors being electrically coupled to a respective one of said array of conductors such that each of said first roller motors is in electrical communication with said control circuit, each of said first roller motors being turned on when said control circuit receives said on input, each of said first roller motors having said primary end of a respective one of said first massage rollers being rotatably coupled thereto wherein said outer surface of each of said first massage rollers is configured to massage the user's body when said control circuit receives said on input; and a plurality of sets of second massage rollers, each of said sets of second massage rollers being movably embedded into said body suit, each of said sets of second massage rollers being positioned at strategic locations on said body suit that correspond to common massage points on the user's body wherein each of said sets of second massage rollers is configured to massage the user's body at the common massage points when each of said sets of second massage rollers is turned on, each of said sets of second massage rollers being in electrical communication with said control circuit, each of said second sets of massage rollers comprising:

a plurality of rollers, each of said rollers being comprised of a resiliently compressible material for enhancing comfort for the user, each of said rollers being positioned between said inside surface and said outside surface of said body suit, each of said rollers having a first end and a second end;

a track including a plurality of rail sections each extending between a plurality of bracket sections, said bracket sections being spaced apart from each other, each of said rollers being positioned within a respective one of said bracket sections, each of said first and second ends of each of said rollers being rotatably coupled to said respective bracket sections, said track being comprised of a pliable material wherein said track is configured to conform to contours of the user's body when said body suit is worn; and a plurality of second roller motors, each of said second roller motors being positioned between said inside surface and said outside surface of said body suit, each of said second roller motors being bonded to said body suit to inhibit each of said second roller motors from moving, each of said second roller motors being positioned on a respective one of said bracket portions of said track, each of said second roller motors having said first end of a respective one of said rollers being rotatably coupled thereto such that each of said second roller motor rotates said respective roller when said second rollers motor are turned on, each of said second roller motors being electrically coupled to a respective one of said array of conductors such that said each of second roller motors is in electrical communication with said control circuit; and a power supply being coupled to said control housing, said power supply being electrically coupled to said control circuit, said power supply comprising:

at least one rechargeable battery being positioned within said control housing, said at least one rechargeable battery being electrically coupled to said control circuit; and a charge port being recessed into said control housing wherein said charge port is configured to insertably receive a plug on a battery charger, said charge port being electrically coupled to said at least one rechargeable battery for charging said at least one rechargeable battery.

* * * * *